United States Patent [19]

Provencher et al.

[11] 4,249,763

[45] Feb. 10, 1981

[54] DEVICE FOR SUSPENDING A SIGN FROM A CEILING AND REMOVING SAME THEREFROM

[76] Inventors: Roland Provencher, 164 Hadley St.; Charles Williams, 1096 Boles St., both of New Bedford, Mass. 02745

[21] Appl. No.: 109,460

[22] Filed: Dec. 31, 1979

[51] Int. Cl.[3] ..... A47F 13/06

[52] U.S. Cl. ..... 294/19 R

[58] Field of Search ..... 294/19 R, 1 R, 85; 248/339, 340, 317, 343; 29/225

[56] References Cited

U.S. PATENT DOCUMENTS

| | | | |
|---|---|---|---|
| 2,576,705 | 11/1951 | Spitz | 294/19 R |
| 3,561,718 | 2/1971 | Iverson | 294/19 R |
| 4,163,576 | 8/1979 | Hoop | 294/19 R |

*Primary Examiner*—James B. Marbert

*Attorney, Agent, or Firm*—Salter & Michaelson

[57] ABSTRACT

A device for suspending a sign from a ceiling and removing same therefrom, wherein the sign includes a string and a pin secured to the end thereof; a handle being provided for inserting the pin into the ceiling for suspending the sign therefrom, the handle also including means for extracting the pin from the ceiling to remove the sign from the suspended position, wherein not only is the use of a ladder avoided in suspending the sign from the ceiling, but is also avoided in removing the sign from the display position as suspended from the ceiling.

9 Claims, 7 Drawing Figures

DEVICE FOR SUSPENDING A SIGN FROM A CEILING AND REMOVING SAME THEREFROM

BACKGROUND OF THE INVENTION

The present invention relates to a device for suspending a display sign from the ceiling of a retail establishment for the purpose of advertising goods as sold in the establishment. The invention also contemplates easily removing the sign from its display position; and in both suspending the sign from the ceiling and removing the sign therefrom, the use of a ladder or the like is avoided.

In certain retail establishments, it has been common practice to suspend signs from the ceiling thereof for the purpose of advertising certain products for sale. Prior to the instant invention, the signs as mounted in the ceiling were supplied with an elongated string that was attached to the sign. Joined to the other end of the string was a pin that was formed with an elongated shank and an enlarged head. In order to mount the sign in place in its suspended position from the ceiling, a ladder was utilized, and the person suspending the signs in place, mounted the ladder and manually inserted each pin of a sign in place in the ceiling, the sign hanging freely on the string as joined to the pin.

The ceilings that were normally utilized for suspending signs for display in the manner as described were of the acoustical type and the pins as inserted in the ceilings were retained in frictional engagement in the acoustical tiles. Removing the signs from their suspended position heretofore has also required the mounting of a ladder, whereupon the persons performing the removal operation had to manually reach the pin while mounted on the ladder for extracting the pin from its inserted position in the ceiling tile.

Since the mounting of the sign in place by the insertion of the pin into the acoustical ceiling has required the use of a ladder and manually inserting the pin in place, considerable time and effort was required to perform this operation, particularly since the ladder had to be moved from place-to-place as each sign was suspended from the ceiling in the display position thereof. Obviously such a procedure has been found to be objectionable, even though the prior known manual procedure did effectively mount the sign in place and provide for the removal thereof. As will be described the present invention avoids the problems heretofore experienced in manually suspending a sign from a ceiling or removing the sign therefrom while mounted on a ladder.

Applicant is unaware of any prior patents or references that disclose the concept as embodied in the subject invention and the best prior art known to applicant as of the filing of the subject application is represented by the following U.S. Pat. Nos.: SARGENT et al, 1,702,319; LIPSON, 2,094,459; INGRAHAM, 2,491,860; SPITZ, 2,576,705; GIERN et al, 2,690,617; FREEMAN et al, 3,327,376; and IVERSON, 3,561,718.

SUMMARY OF THE INVENTION

The present invention includes a device for suspending a sign from a ceiling in a display position and thereafter removing the sign from the suspended display position, wherein the sign includes a string, one end of which is attached thereto and a pin having a head that is mounted on the other end of the string. The device as embodied in the invention includes an elongated handle, on one end of which means are located for receiving the head end of the pin therein and thereby exposing a substantial portion of the shank portion and the pointed end of the pin. The handle is lifted upwardly with the pin located therein toward the ceiling to cause the pointed end of the pin to penetrate into the ceiling for insertion therein, whereupon movement of the handle downwardly leaves the pin frictionally mounted in the ceiling and the sign as attached to the string suspended therefrom in the display position. Means are secured to the other end of the handle for positively engaging the pin as mounted in the ceiling, whereupon movement of the handle downwardly extracts the pin from the inserted position in the ceiling to remove the sign from the suspended and display position thereof.

It is therefore an object of the present invention to provide a device for suspending a sign from a ceiling in a display position which includes a handle for inserting a pin in the ceiling, the pin being interconnected to the sign and the handle also including means for removing the pin and the sign from the suspended display position.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
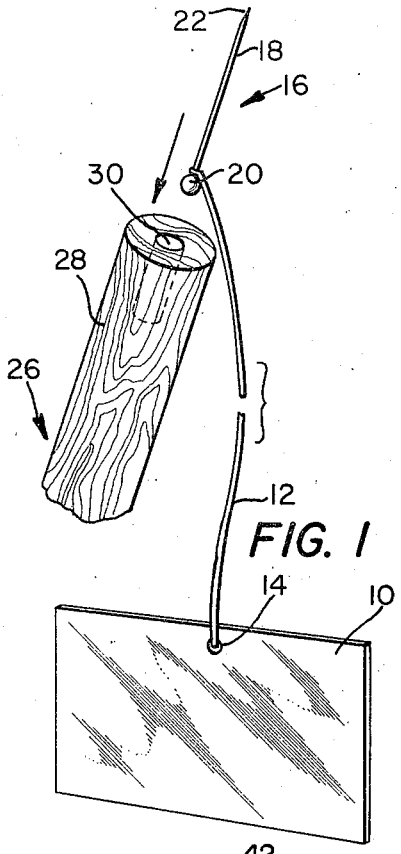
FIG. 1 is a perspective view of one end of the handle embodied in the device of the subject invention, a pin as attached to a display sign being illustrated just prior to the insertion of the head end thereof into a bore as formed in the end of the handle.
Figure 4:
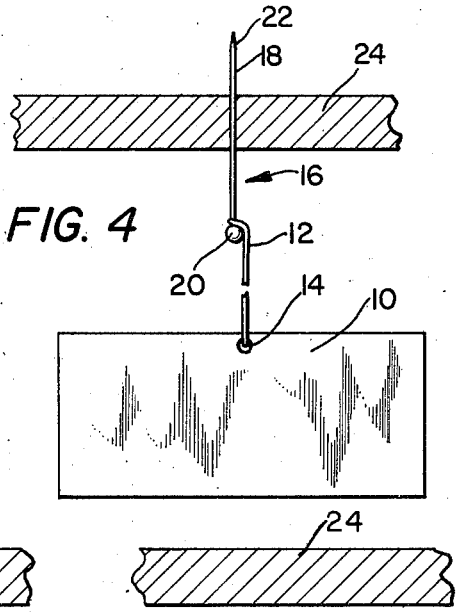
FIG. 4 is an elevational view of the sign and pin attached thereto with the ceiling shown in section and illustrating the location of the pin in the inserted position in the ceiling for suspending a sign for display therefrom.

Referring now to the drawing and particularly to FIGS. 1 and 4, a sign 10 is illustrated and is generally of that type that is formed of a relatively thin material such as plastic or cardboard and on both surfaces of which advertising information is imprinted. It is understood that any suitable advertising material or design may be imprinted on the sign 10 depending upon the article that is being advertised for sale thereon. Attached to the sign 10 adjacent to an edge thereof is a string 12 that may be secured to the sign in any suitable manner; although as illustrated the string extends through an opening 14 as formed in the sign and is tied therein. Secured to the outer end of the string 12 is a straight pin generally indicated at 16 that is formed with an elongated shank 18 on one end of which a head 20 is joined. The other end of the shank 18 is formed with a pointed end 22, the pointed end 22 being insertable into a ceiling as will be described hereinafter.

As described, the sign 10 which includes the string 12 and pin 16 are all conventional in construction and have normally been used therefore in the advertising or display of articles in retail store establishment. Normally, the pin 16 is inserted into an acoustical ceiling tile, one of which is indicated at 24 in the drawing; although it is understood that the pin 16 may be inserted into any form of a ceiling, so long as the pin may be penetrated therein for the mounting of the pin in place, thereby suspending the sign 10 from the ceiling.

Figure 2:
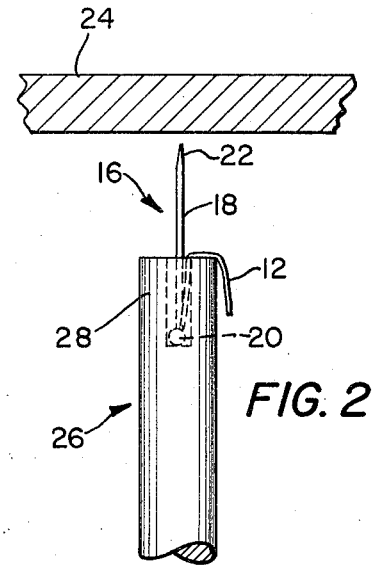
FIG. 2 is an elevational view of the end of the handle illustrated in FIG. 1 with the head end of the pin inserted therein and prior to mounting of the pin in a ceiling that is shown in section.
Figure 3:
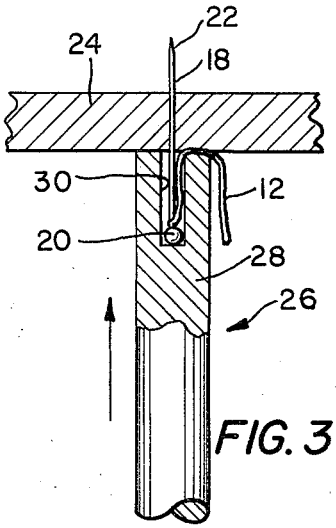
FIG. 3 is a view similar to FIG. 2 with parts of the handle shown in section and after the shank end of the pin has been inserted into the ceiling.

The device as embodied in the present invention for mounting the sign in place in the ceiling 24 includes an elongated handle generally indicated at 26, one end of which is illustrated at 28 in FIGS. 1, 2 and 3. The handle 26 is formed of any suitable stock material such as wood, metal or plastic and is circular in cross section. The handle 26 is also of a diameter that is physically easy to grip by hand and is of a length that would enable the user thereof to conveniently locate the end 28 at the ceiling 24 without mounting a ladder. As shown in FIG. 1, the end 28 of the handle 26 has an internal bore 30 formed therein, the diameter of which is slightly larger than the diameter of the head 20 of the pin 16. The bore 30 also extends inwardly of the end 28 sufficiently to enable the pin 16 to be seated therein with a substantial portion of the shank 18 exposed so that the shank 18 may be penetrated into the ceiling 24 for frictionally mounting the pin 16 in place therein. As shown in FIGS. 2 and 3, the pin 16 is located in position in the bore 30 by placing the head 20 of the pin at the bottommost end of the bore 30, thereby leaving a major portion of the shank 18 and the pointed end 22 exposed.

In order to suspend the sign 10 from the ceiling 24, the pin 16 is located in the bore 30 of the handle 26 with the shank 18 exposed and the user then lifts the handle 26 upwardly toward the ceiling 24 until the pointed end 22 of the pin strikes the under surface thereof. The handle 26 is thereafter urged upwardly to cause the pointed end 22 and shank 18 of the pin to penetrate into the ceiling 24 until the uppermost end of the handle 26 contacts the undersurface of the ceiling 24 as illustrated in FIG. 3. With the pin 16 inserted into the ceiling, the handle 26 is then withdrawn from contact with the underside of the ceiling 24, thereby leaving the inserted pin 16 in frictional engagement with the ceiling, as shown in FIG. 4. The sign which is tied to the string that is secured to the pin 16 is thus mounted in a suspended display position relative to ceiling 24, the sign being visually accessible to the customers of the retail establishment. It is understood that the height of the sign 10 from the floor of the establishment will be determined by the length of the string 12 that is secured to the mounted pin 16.

Figure 5:
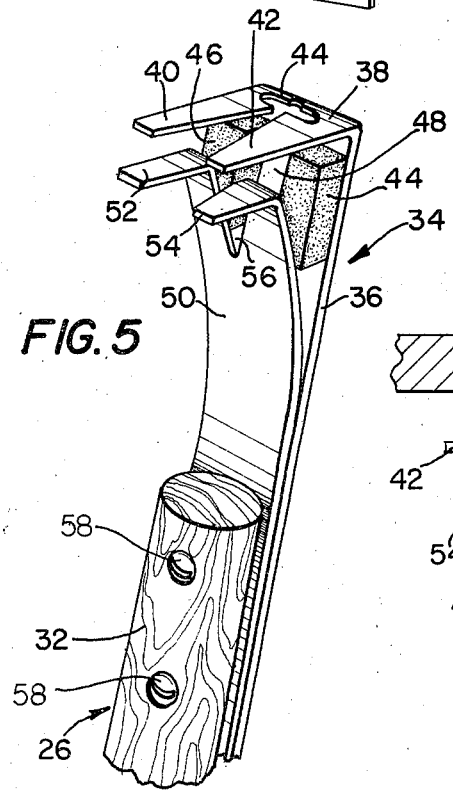
FIG. 5 is a perspective view of the other end of the handle showing the extracting means for removing the pin from the inserted position in the ceiling.

Referring now to FIG. 5, the end of the handle 26 opposite the end 28 is illustrated and is indicated at 32. Attached to the end 32 of the handle 26 is a pin extracting device generally indicated at 34, the pin extracting device 34 including a first bracket 36 having a flange 38 joined thereto at the outer end thereof. Formed as part of the flange 38 are spaced legs 40 and 42, the space between the legs 40 and 42 having an inwardly reducing taper that forms a substantially V-shaped slot and that terminates in a cross slot 44. As will be described the innermost end of the V-shaped slot as formed between the legs 40 and 42 and that is located adjacent to the cross slot 44, has a lateral dimension that is somewhat less than the diameter of the pin 20. However, the lateral dimension of the V-shaped slot as formed between the legs 40 and 42 at this point is greater than the diameter of the shank 18 of the pin 16, thereby permitting entry of the shank 18 therethrough and into the cross slot 44. Thus just prior to the pin extracting operation, the shank 18 of the pin 16 is moved through the V-shaped slot between the legs 40 and 42 of the flange 38 to locate the head 20 of the pin beneath the cross slot 44 as formed in the flange 38.

Figure 6:
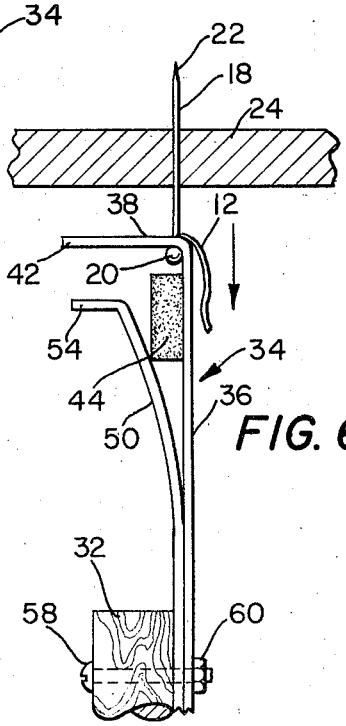
FIG. 6 is an elevational view of the other end of the handle and illustrating the location of the pin in the handle extracting end prior to removal of the pin from the ceiling.

Secured to the bracket 36 and located beneath the flange 38 are spaced magnets 44 and 46, the spacing between the magnets 44 and 46 defining a channel 48. Also secured to the end 32 of the handle 26 is a second bracket 50 that is curved outwardly at the outer end thereof as illustrated in FIGS. 5 and 6 so as to be spaced from the bracket 36 at the outer ends thereof. The bracket 50 is formed with spaced flanges 52 and 54 on the outermost end thereof, the flanges 52 and 54 being separated by a V-shaped slot 56. As seen in FIG. 6, the flanges 52 and 54 are located beneath the legs 40 and 42 of the flange 38 and are vertically spaced therefrom. As will be described, the V-shaped slot 56 provides for entry of the head 20 of the pin 16 into the channel 48 that is defined between the magnets 44 and 46 and beneath the flange 36 when the pin 16 is to be extracted from the ceiling tile 24. As further shown in FIGS. 5 and 6, both the brackets 36 and 50 are secured to the end 32 of the handle 26 by bolts 58 on which nuts 60 are threadably received.

Figure 7:
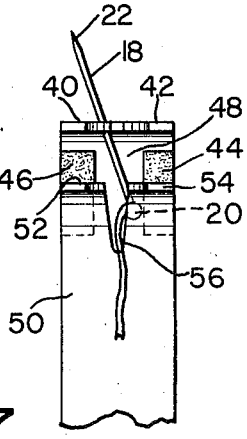
FIG. 7 is a front elevational view showing the location of the pin after it has been removed by the handle from the inserted position thereof in the ceiling.

In use of the device, the sign 10 is first suspended from the ceiling 24 as described hereinabove, the end 28 of the handle 26 being utilized for this purpose, and the sign 10 thereby hanging freely from the pin 16 after it has been inserted into the ceiling 24. When the sign 10 is to be removed from the suspended display position thereof, the user elevates the end 32 of the handle 26 to place the extracting device 34 in position for removing the pin 16. In order to locate the extracting device 34 in proper position, the user locates the head 20 of the pin 18 below the flange 38, the head 20 having been directed through the V-shaped slot 56 as formed between the flanges 52 and 54 of the bracket 50. As the head 20 of the pin is moved beneath the flange 38 the shank 18 of the pin 20 passes through the V-shaped slot as formed between the legs 40 and 42 and into the channel 48 between the magnets 44 and 46, the head 20 of the pin being positioned beneath the cross slot 44 as formed in the flange 38. In this position, the shank 18 of the pin 16 extends substantially longitudinally of the channel 48 as formed between the magnets 44 and 46. When the user pulls downwardly on the handle 26, the extracting device assumes the position as illustrated in FIG. 6 wherein the head 20 of the pin 16 engages the underside of the flange 38. Further downward movement of the handle 26 extracts the pin from the ceiling 24, and at this point the pin 16 falls free and downwardly through the channel 48 but is captured between the brackets 36 and 50 by the magnets, the pin being attracted to either the magnet 44 or 46 depending upon the downward movement thereof. With the pin 16 held in place by the extracting device 34 as shown in FIG. 7, the handle 26 is lowered by the user to enable the sign 10 that is interconnected to the pin 16 through the string 12 to be grasped, whereupon the entire sign assembly including the pin 16 and string 12 can be removed from the handle 26 for storage and/or further use.

It is seen that the sign extracting device 34 is simple to place in position for locating the head 20 of the pin 16 beneath the flange 38. The magnets 44 and 46 further insure that the pin 16 will be held in place after the pin has been extracted from the ceiling 24, thereby preventing the sign from falling downwardly onto the floor of the establishment after the removal operation. By use of the device as described, the sign 10 may be simply and quickly suspended in place from a ceiling for the display thereof, and when removal thereof from the suspended and display position is desired, the device is also simply and easily employed for this purpose. It is further seen that by using the device, the use of ladders for hanging or removing the signs is avoided, and a number of signs can either be mounted in place in a suspended and display position or removed therefrom in a relatively short period of time.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for suspending a sign from a ceiling in a display position and thereafter removing the sign from the suspended display position, wherein said sign includes a string, one end of which is attached thereto, and a pin having a head that is mounted on the other end of said string, comprising an elongated handle on one end of which means are located for receiving the head end of said pin therein and thereby exposing a substantial portion of the shank portion and the pointed end of said pin, whereafter said handle is lifted upwardly toward said ceiling to cause the pointed end of said pin to penetrate into said ceiling for insertion therein, whereupon movement of said handle downwardly leaves said pin frictionally mounted in said ceiling and said sign as attached to said string suspended therefrom in the display position thereof, and means secured to said handle for positively engaging said pin as mounted in said ceiling, whereupon movement of said handle downwardly extracts said pin from the inserted position in said ceiling to remove the sign from the suspended and display position thereof.

2. A device as claimed in claim 1, said means for receiving the head of said pin therein being defined by a bore that is formed in said one end of said handle, said bore having a diameter for loosely receiving the head end of the pin therein and having a longitudinal dimension that enables a substantial portion of the shank portion of the pin to be exposed when the pin is located in said bore.

3. A device as claimed in claim 1, said pin engaging means including a bracket that is secured to said the other end of said handle, said bracket including a flange that is located substantially perpendicular to the longitudinal axis of said handle, and a slot formed in said flange for guiding the shank portion of said pin therein for locating the head end of said pin below said flange when the pin is to be extracted from said ceiling.

4. A device as claimed in claim 3, the slot as formed in the flange of said bracket having an inwardly reducing taper, so that the lateral dimension of the innermost end of the slot is such that the head of said pin is restricted against upward movement by said flange when located thereunder.

5. A device as claimed in claim 4, a cross-slot formed in said flange adjacent to and in communication with said tapered slot and receiving the shank end of the pin therein during the sign removing operation.

6. A device as claimed in claim 1, said pin engaging means including a bracket that is secured to the other end of said handle and magnet means mounted on said bracket and being magnetically engageable with said pin after said pin has been extracted from the inserted position thereof thereby assisting in retaining said pin in engagement with said handle during the sign removal operation.

7. A device as claimed in claim 6, said bracket including a flange having a slot formed therein, said magnet means being located below and adjacent to said slot, wherein said slot provides for entry of said pin therein with the head of the pin located beneath said flange so that the head of said pin engages the underside of said flange during the pin removal operation, whereafter said pin is attracted to said magnet that effectively prevents said pin and sign from falling free after the pin is extracted from the ceiling.

8. A device as claimed in claim 7, said magnet means including a pair of magnets that are secured to said bracket and beneath said flange in spaced apart relation to define a channel therebetween, said pin being removable by gravity into said channel for retention therein by said magnets after the extraction thereof from said ceiling.

9. A device as claimed in claim 8, a second flange joined to said bracket and spaced below said first flange, slot means formed in said second flange and cooperating with the slot in said first flange for permitting entry of said pin therethrough during the sign removing operation.

* * * * *